US006663425B1

(12) United States Patent
Zhang et al.

(10) Patent No.: US 6,663,425 B1
(45) Date of Patent: Dec. 16, 2003

(54) ELECTRICAL CONNECTOR WITH RELIABLY ASSEMBLED SHIELD AND HOUSING

(75) Inventors: Jian Qiang Zhang, Kunshan (CN); Li Qi Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/291,288

(22) Filed: Nov. 7, 2002

(51) Int. Cl.[7] ..... H01R 13/648
(52) U.S. Cl. ..... 439/607
(58) Field of Search ..... 439/607, 357, 439/108

(56) References Cited

U.S. PATENT DOCUMENTS 5,254,010 A * 10/1993 Davis ..... 439/108
6,186,807 B1 2/2001 Simmel
6,203,335 B1 3/2001 Chang
6,203,373 B1 * 3/2001 Lin ..... 439/607
6,231,390 B1 * 5/2001 Chang ..... 439/607
6,383,010 B1 5/2002 Mayo et al.
6,416,360 B1 * 7/2002 Zhang et al. ..... 439/607
6,503,108 B1 * 1/2003 Kikuchi et al. ..... 439/680

FOREIGN PATENT DOCUMENTS

JP 06-068936 3/1994
JP 11-185862 7/1999

* cited by examiner

*Primary Examiner*—Chandrika Prasad
(74) *Attorney, Agent, or Firm*—We Te Chung

(57) ABSTRACT

An electrical connector (100) has an insulative housing (8), a plurality of terminals (9) received in the housing and a metal shield (7). The housing has a body portion (81) and two side portions (82) formed respectively on lateral sides of the body portion. Each side portion has a passage (821) extending therethrough and a notch (822) in communication with the passage. The shield has two retentive tabs (731) respectively projecting through corresponding passages with free ends thereof received in corresponding notches of the housing. The terminals have vertical contacting sections (91), vertical connecting sections (93), horizontal retention sections (92) connecting the contacting sections with the connecting sections, and soldering sections (94) extending horizontally from the connecting sections.

9 Claims, 5 Drawing Sheets

ELECTRICAL CONNECTOR WITH RELIABLY ASSEMBLED SHIELD AND HOUSING

CROSS-REFERENCE TO RELATED APPLICATIONS

This application is a co-pending application of U.S. patent application Ser. No. 09/947,245 filed on Sep. 5, 2001 and entitled "INPUT/OUTPUT CONNECTOR HAVING FIRMLY ASSEMBLED INSULATIVE HOUSING AND SHELL", U.S. patent application Ser. No. 10/126,847 filed on Apr. 19, 2002 and entitled "ELECTRICAL CONNECTOR WITH METAL SHIELD", and U.S. patent application Ser. No. 10/143,616 filed on May 9, 2002 and entitled "ELECTRICAL CONNECTOR SUPPORTED ON PRINTED CIRCUIT BOARD", all assigned to the same assignee as the present invention.

BACKGROUND OF THE INVENTION

1. Field of the Invention

The present invention generally relates to an electrical connector, and more particularly to an electrical connector having a shield and a housing reliably engaged with each other.

2. Description of the Prior Art

It is well known that a cellular phone is provided with an electrical connector for enabling the cellular phone to connect with an auxiliary electrical device.

U.S. Pat. No. 6,186,807 discloses an electrical connector assembly having a metal shield, a dielectric housing with U-shaped channels and a plurality of terminals received in the U-shaped channels of the housing. The metal shield is mountable on a substrate in at least two orientations. Each terminal is generally U-shaped to define a pair of leg portions, an offset tail extending from one of the leg portions and a bight portion joining the pair of leg portions. The bight portions of the terminals have front contact faces for engaging appropriate contact portions of terminals of a complementary mating connector.

However, there is no retention means between the metal shield and the dielectric housing, so that the metal shield can not be retained reliably on the housing when the complementary mating connector is inserted into or pulled out of the electrical connector assembly.

U.S. Pat. No. 6,203,335 discloses a conventional electrical connector having a shield, a housing and a plurality of terminals. The shield has a pair of locking tabs, and the housing defines a pair of recesses for receiving corresponding locking tabs. However, the locking tabs are apt to distort when a push force is exerted on the housing, so that the locking tabs cannot effectively resist a push force acting on the housing during insertion of a complementary connector into the connector. As a result, the engagement between the housing and the shield may be broken, thereby adversely transmitting the acting force directly to the solder joint connections between the terminals and a printed circuit board.

Hence, an improved connector is needed to eliminate the above mentioned defects of the conventional connectors.

BRIEF SUMMARY OF THE INVENTION

The main object of the present invention is to provide an electrical connector having a shield and a housing reliably engaged with each other.

An electrical connector of the present invention has an insulative housing, a plurality of terminals received in the housing, and a metal shield. The housing has a body portion and two side portions formed respectively on lateral sides of the body portion. Each side portion has a passage extending therethrough, a front notch and a rear recess respectively in communication with the passage. the shield has two retentive tabs each having an engaging portion projecting through a corresponding passage. The engaging portions of the retentive tabs have free ends received in corresponding notches of the housing. Connecting portions of the retentive tabs upwardly extend from a bottom wall of the shield and are received in corresponding recesses of the housing. The terminals have vertical contacting sections, connecting sections extending parallel to the contacting sections, retention sections connecting the contacting section with the connecting sections, and soldering sections extending horizontally from the connecting sections.

Other objects, advantages and novel features of the invention will become more apparent from the following detailed description of a preferred embodiment when taken in conjunction with the accompanying drawings.

DETAILED DESCRIPTION OF THE INVENTION

Figure 1:
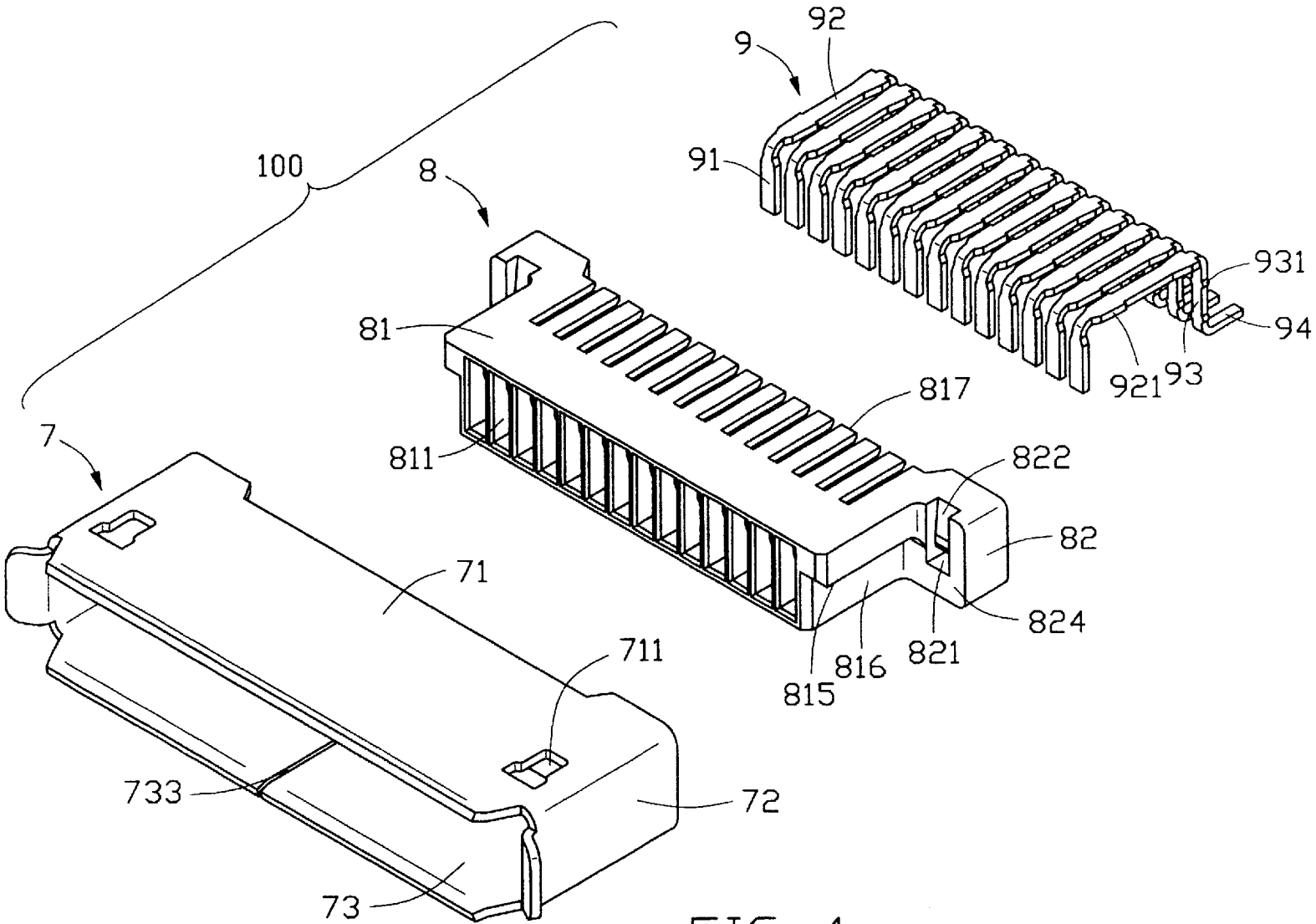
FIG. 1 is an exploded view of an electrical connector of the present invention.
Figure 2:
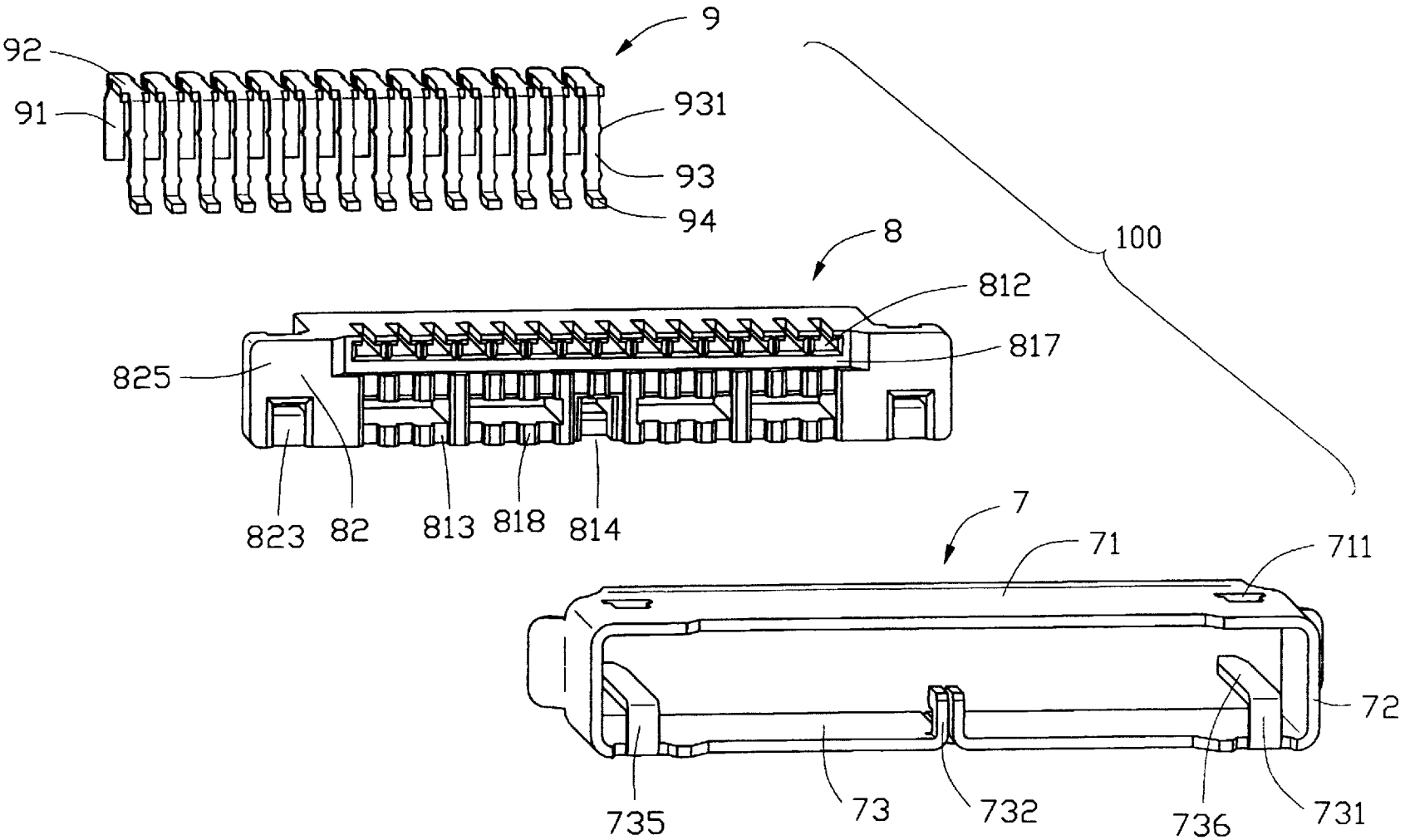
FIG. 2 is a view similar to FIG. 1, but viewed from a rear aspect.

Referring to FIGS. 1 and 2, an electrical connector 100 of the present invention has a dielectric housing 8, a plurality of terminals 9 for being received in the housing 8, and a shield 7 for enclosing the housing 8. For clarity, the terminals 9 are shown in a final configuration.

The shield 7 has a top wall 71, two side walls 72 and a bottom wall 73. The top wall 71 defines a pair of holes 711 respectively adjacent to corresponding side walls 72 for engaging with latching portions of a complementary connector (not shown). The bottom wall 73 of the shield I has a pair of retentive tabs 731 upwardly extending from a rear edge thereof respectively adjacent to corresponding side walls 72, a slit 733, and a projection 732 aligned with the slit 733. The retentive tabs 731 have connecting portions 735 connecting to the bottom wall 73 of the shield 7, and engaging portions 736 extending perpendicularly from corresponding connecting portions 735. The projection 732 includes two identical portions (not labeled). The slit 733 is defined in a middle portion of the bottom wall 73 of the shield 7 between the two identical portions of the projection 732.

The housing 8 has an elongated body portion 81 and two side portions 82 formed respectively on two lateral sides of the body portion 81. The body portion 81 has a rear wall 817 and two side walls 816. The body portion 81 defines a plurality of passageways 811 extending therethrough, and a plurality of cavities 812 in communication with corresponding passageways 811. The rear wall 817 of the body portion 81 has an aperture 814 for receiving the projection 732 of the shield 7, a plurality of ribs 818 and a plurality channels 813 defined between the ribs 818. Each of the side walls 816 has a step-like face 815 so that the complementary connector can not be inserted into the electrical connector 100 in a wrong direction. Each side portion 82 has a front face 824, a rear face 825 and a passage 821 extending therethrough. A notch 822 and a recess 823 are respectively defined in an upper portion of the front face 824 and a lower portion of the rear face 825 of each side portion 82. The notch 822 and the recess 823 communicate with each other via the passage 821. The notch 822, the recess 823 and the passage 821 are adapted for cooperatively engaging with a corresponding retentive tab 731 of the shield 7. A front surface 826 (FIG. 5) defines a rearward extent of each notch 822 and is an inclined face.

The terminals 9 are stamped from a metal sheet and are in a straight configuration (not shown) before assembly. Each terminal 9 has a contacting section 91, a retention section 92 extending perpendicularly from the contacting section 91, a soldering section 94 extending parallel to the retention section 92, and a connecting section 93 connecting the retention section 92 to the soldering section 94. The retention sections 92 and the connecting sections 93 respectively form a plurality of barbs 921, 931 on opposite sides thereof.

Figure 3:
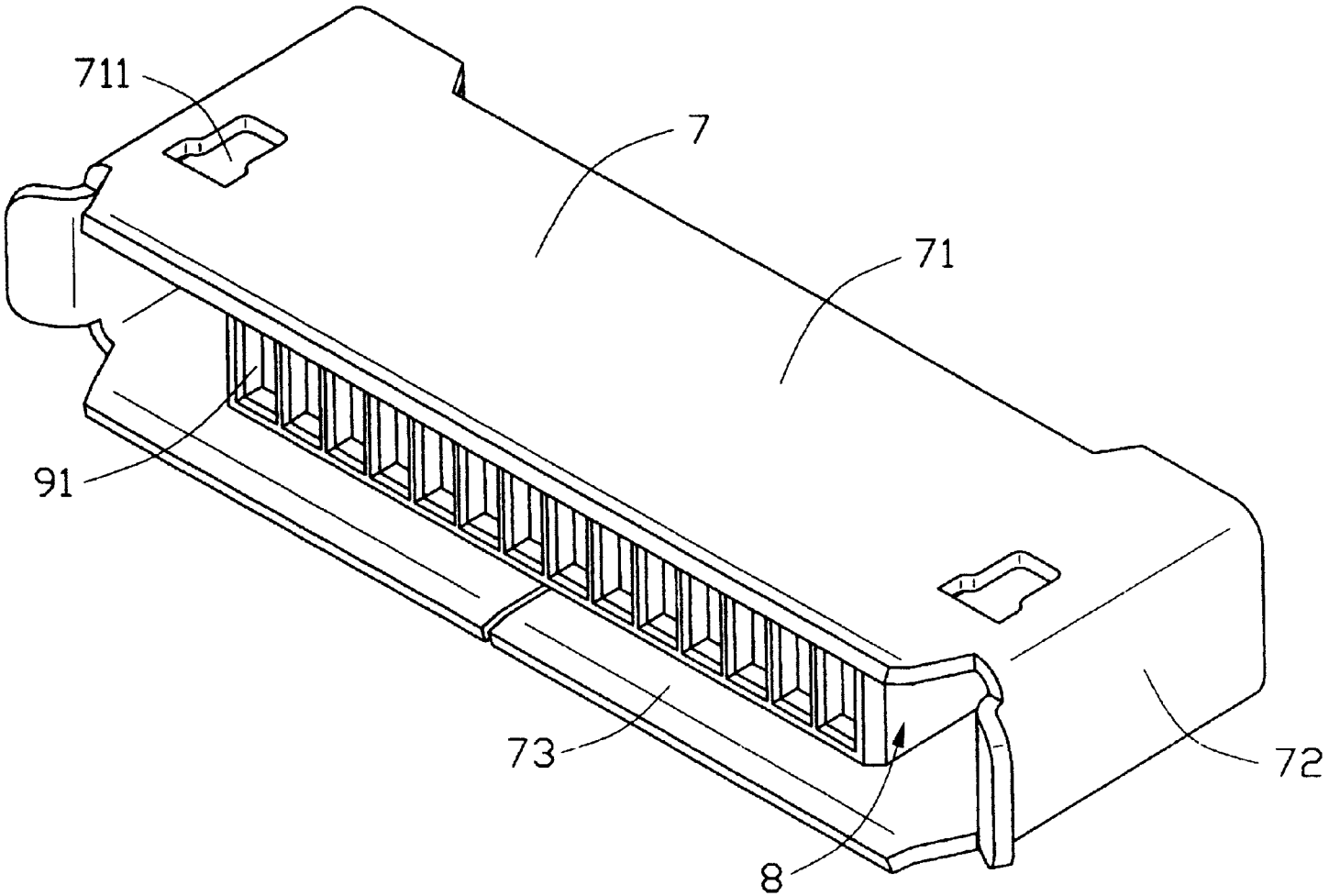
FIG. 3 is an assembled view of FIG. 1.
Figure 4:
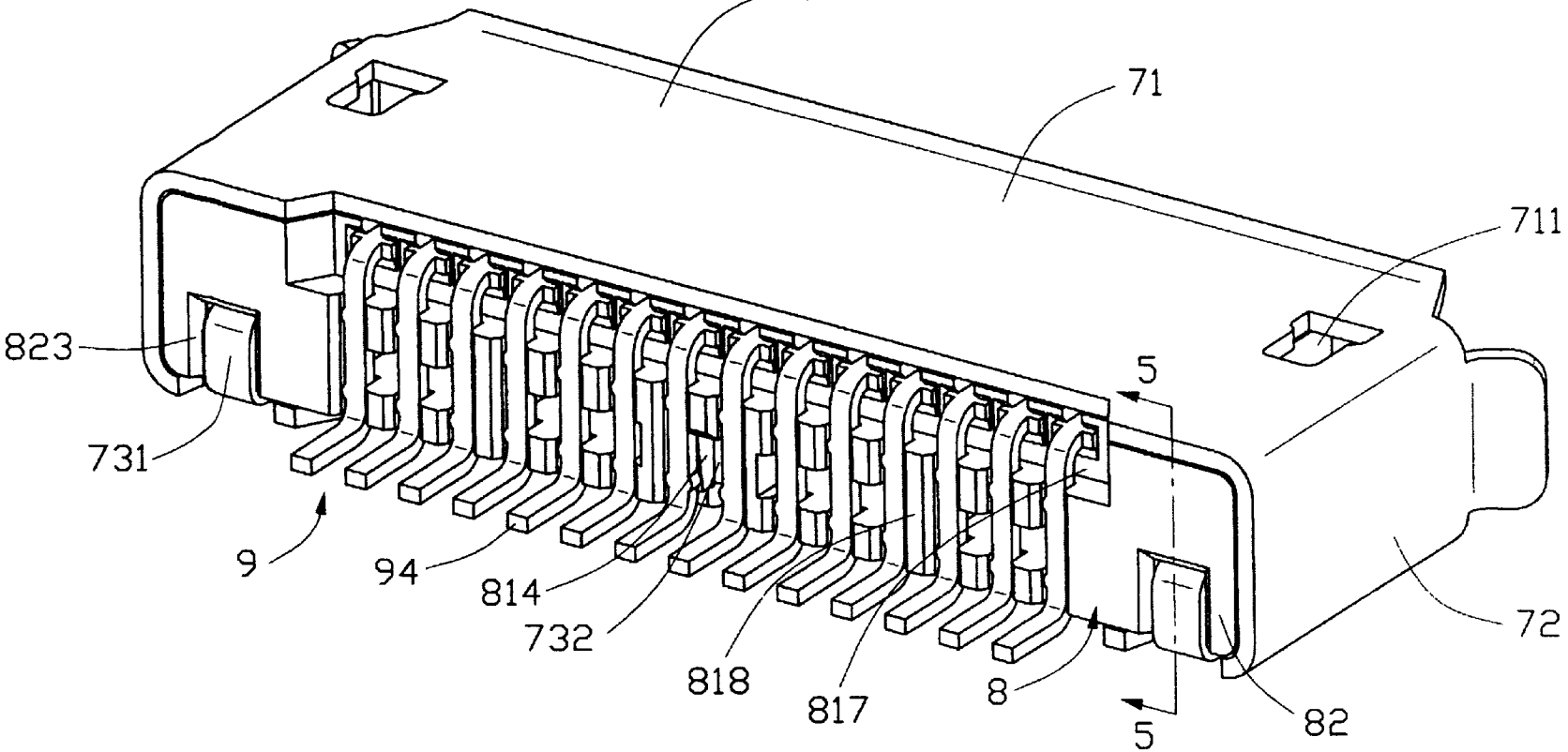
FIG. 4 is an assembled view of FIG. 2.
Figure 5:
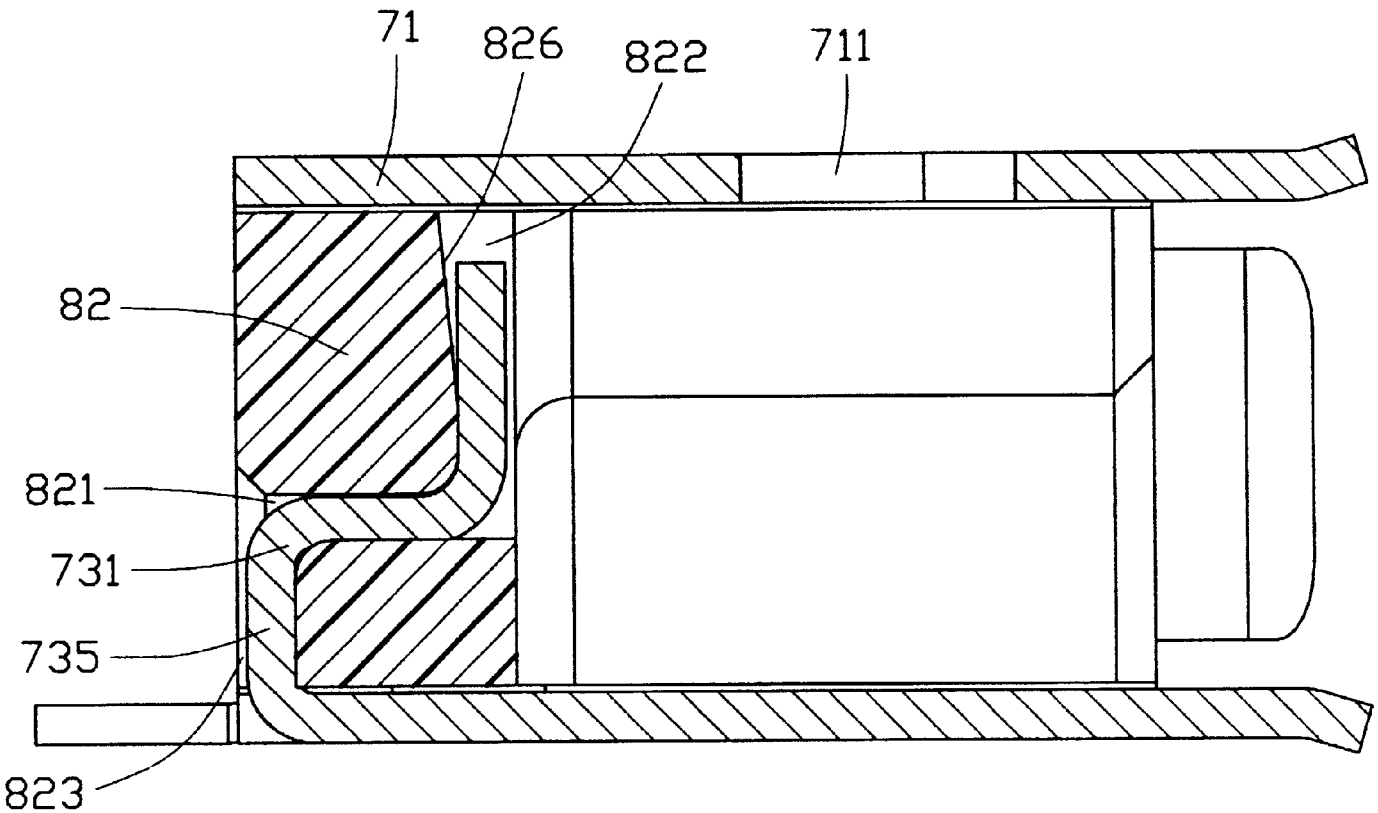
FIG. 5 is a cross-sectional view taken along line 5—5 of FIG. 4.

Referring to FIGS. 3, 4 and 5, in assembly, the plurality of terminals 9 are inserted into the body portion 81 of the housing 8 with retention sections 92 received in corresponding cavities 812 of the body portion 81. The contacting sections 91 of the terminals 9 are downwardly bent from one end of the retention sections 92 are received in corresponding passageways 811 of the body portion 81. The connecting sections 93 of the terminals 9 are downwardly bent and are received in corresponding channels 813 of the body portion 81. The plurality of barbs 921, 931 of the retention sections 92 and the connecting sections 93 of the terminals 9 respectively bite into inner walls of corresponding cavities 812 and channels 813 for a secure engagement therebetween. The soldering sections 94 of the terminals 9 are bent away from the body portion 81 of the housing 8 and extend horizontally and rearwardly from the connecting sections 93.

The body portion 81 of the housing 8 is enclosed by the shield 7, bottom sides of the soldering sections 94 of the terminals 9 lying substantially coplanar with a bottom surface of the bottom wall 73 of the shield 7, so that the soldering sections 94 of the terminals 9 can be properly soldered to circuit traces on a printed circuit board (PCB) where the connector 100 is mounted. The engaging portions 736 of the retentive tabs 731 of the shield 7 are inserted into corresponding passages 821 of the housing 8 with free ends thereof upwardly bent and received in corresponding notches 822 of the side portions 82 of the housing 8. The connecting portions 735 of the retentive tabs 731 of the shield 7 are received in corresponding recesses 823 of the side portions 82 of the housing 8, so that a secure engagement between the housing 8 and the shield 7 is formed. The projection 732 is received in the aperture 814 of the housing 8 to further secure the engagement of the housing 8 and the shield 7.

An advantage of the present invention over the prior art results from the fact that the engaging portions 736 of the retentive tabs 731 of the shield 7 engage with corresponding passages 821 of the housing 8 with the free ends thereof bent and received in corresponding notches 822, and the connecting portions 735 of the retentive tabs 731 are received in corresponding recesses 823 of the housing 8. Said advantage for the results from the fact is that the projection 732 of the shield 7 is received in the aperture 814 of the housing 8. Said advantage of the present invention over the prior art is that the shield 7 and the housing 8 are reliably engaged with each other, so that the shield 7 and housing 8 are not separated from each other when the complementary connector is inserted into or pulled out of the electrical connector 100. Alternatively, the retentive tabs 731 of the shield 7 may extend from a rear edge of the top wall 71 of the shield 7, and accordingly the front notches 822 and the rear recesses 823 are respectively defined in lower and upper portions of the side portions 82 of the housing 8.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a body portion and two side portions formed respectively on lateral sides of the body portion, each side portion having a passage extending therethrough and a notch in communication with the passage, each side portion having a front and a rear face, said notch being defined in the front face of the side portion;

a plurality of terminals received in the body portion of the housing; and a metal shield enclosing the insulative housing, the metal shield having a top wall, a bottom wall, and two retentive tabs extending from a rear edge of one of the top and bottom walls, the retentive tabs having engaging portions projecting through corresponding passages of the housing with free ends thereof received in corresponding notches.

2. The electrical connector of claim 1, wherein the body portion of the housing has an aperture, and the metal shield has a projection formed between the retentive tabs and engaging with the aperture.

3. The electrical connector of claim 2, wherein the projection has two identical portions, and the bottom wall of the shield defines a slit between the two identical portions.

4. The electrical connector of claim 1, wherein an inclined front surface defines a rearward extent of each notch.

5. The electrical connector of claim 1, wherein each side portion of the housing defines a recess in a rear face thereof in communication with a corresponding passage.

6. The electrical connector of claim 5, wherein each retentive comprises a connecting portion which extends between the rear edge of the one of the top and bottom walls and the engaging portion, said connecting portion being received in a corresponding recess of the housing, and the engaging portion of the retentive tab extending perpendicularly from the respective connecting portion.

7. An electrical connector, comprising: an insulative housing having a body portion and two side portions formed respectively on lateral sides of the body portion, each side portion having a passage extending therethrough, a notch defined in a front face thereof, and a recess defined in a rear face thereof, the notch, the recess and the passage communicating with each other; a plurality of terminals received in the body portion of the housing; and a metal shield disposed on the insulative housing, the metal shield having two retentive tabs, the retentive tabs having engaging portions projecting through corresponding passages of the housing with free ends thereof received in corresponding notches, and connecting portions received in corresponding recesses of the housing.

8. The electrical connector of claim 7, wherein the shield has a top wall and a bottom wall, and the connecting portions of the retentive tabs extend from a rear edge of one of the top and the bottom walls.

9. The electrical connector of claim 7, wherein the body portion of the housing defines an aperture in a rear wall thereof, and the metal shield has a projection formed between the retentive tabs and engaging with the aperture.

* * * * *